US007543660B2

(12) United States Patent
Crawford et al.

(10) Patent No.: US 7,543,660 B2
(45) Date of Patent: Jun. 9, 2009

(54) ROLLER CONE DRILL BIT WITH DEBRIS DIVERTER PLUGS

(75) Inventors: Michael B. Crawford, Montgomery, TX (US); Mark E. Williams, The Woodlands, TX (US); William C. Saxman, Montgomery, TX (US); Mark P. Blackman, Conroe, TX (US); Gerald L. Pruitt, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 203 days.

(21) Appl. No.: 11/677,158

(22) Filed: Feb. 21, 2007

(65) Prior Publication Data

US 2007/0193779 A1 Aug. 23, 2007

Related U.S. Application Data

(60) Provisional application No. 60/775,826, filed on Feb. 21, 2006.

(51) Int. Cl.
*E21B 10/22* (2006.01)
*E21B 10/23* (2006.01)

(52) U.S. Cl. ..... 175/371; 175/372; 384/94

(58) Field of Classification Search ..... 175/313, 175/371; 384/94

See application file for complete search history.

(56) References Cited

U.S. PATENT DOCUMENTS

| | | | | |
|---|---|---|---|---|
| 4,730,681 | A | 3/1988 | Estes | 175/39 |
| 5,056,610 | A | 10/1991 | Oliver et al. | 175/371 |
| 5,358,061 | A | 10/1994 | Van Nguyen | 175/371 |
| 5,524,510 | A | 6/1996 | Davies et al. | 76/108.2 |
| 6,533,051 | B1 | 3/2003 | Singh et al. | 175/371 |
| 6,725,947 | B2 | 4/2004 | Palaschenko et al. | 175/39 |
| 7,044,242 | B2 | 5/2006 | Miglierini et al. | 175/313 |
| 2006/0113116 | A1 | 6/2006 | Miglierini et al. | 175/371 |

*Primary Examiner*—David J Bagnell
*Assistant Examiner*—Brad Harcourt
(74) *Attorney, Agent, or Firm*—Baker Botts L.L.P.

(57) ABSTRACT

A roller cone drill bit having a bit body with at least one support arm extending from the bit body. Each support arm may have an associated spindle extending inwardly. A respective cone assembly may be rotatably disposed on each spindle. At least one diverter plug may be disposed in a hole formed in each support arm. A void space may be formed between one end of each diverter plug and the bottom of the associated hole. At least one fluid flow passageway may extend from the surface of the associated support arm to the void space to allow communication of fluid containing debris with the void space. Rotating action of the roller cone drill bit and associated cone assemblies may force packing of debris into the void space which results in biasing the diverter plug outwardly from the associated hole to contact adjacent portions of the associated cone assembly.

20 Claims, 5 Drawing Sheets

ROLLER CONE DRILL BIT WITH DEBRIS DIVERTER PLUGS

RELATED APPLICATIONS

This application claims the benefit of provisional patent application entitled "Roller Cone Drill Bit With Debris Diverter Plugs," Application Ser. No. 60/775,826 filed Feb. 21, 2006.

TECHNICAL FIELD

The present disclosure is related to roller cone drill bits used to form wellbores in subterranean formations and more particularly to roller cone drill bits with diverter plugs biased toward adjacent portions of associated cone assemblies.

BACKGROUND OF THE DISCLOSURE

A wide variety of roller cone and rotary cone drill bits have previously been used to form wellbores or boreholes in subterranean formations. Roller cone drill bits generally include at least one support arm and often three support arms. A cone assembly may be rotatably mounted on a spindle or journal extending inwardly from an interior surface of each support arm. Small gaps are generally provided between adjacent portions of each support arm and associate cone assembly to allow rotation of the cone assembly relative to the respective support arm and spindle while drilling a wellbore.

Protection of bearings and related supporting structures which allow rotation of a cone assembly relative to an associated support arm and spindle may lengthen the life of an associated roller cone drill bit. Once downhole debris is allowed to infiltrate between bearing surfaces of a cone assembly and associated spindle, failure of the drill bit will generally follow shortly thereafter. Various mechanisms and techniques have been used to prevent debris from contacting such bearing surfaces.

A typical approach is to install a fluid seal in a gap formed between adjacent portions of each cone assembly and associated spindle. Such fluid seals maintain lubrication in bearings and associated supporting structures and prevent intrusion of shale, formation cuttings and other types of downhole debris. Once the fluid seal fails, downhole debris may quickly contaminate bearing surfaces via the gap. Thus, it is important that fluid seals also be protected against damage caused by downhole debris.

Various approaches have previously been used to protect fluid seals in roller cone drill bits from downhole debris. One approach is to install hardfacing and/or wear buttons on opposite sides of gaps formed between each cone assembly and associated support arm on exterior portions of the drill bit. Hardfacing and wear buttons generally slow erosion of metal adjacent to such gaps to prolong downhole drilling time before an associated fluid seal may be exposed to downhole debris. Another approach is to form tortuous fluid flow paths proximate each gap leading to an associated fluid seal. Tortuous fluid flow paths allow rotation of a cone assembly relative to an associated spindle but are often difficult for downhole debris to follow.

Various types of debris diverter plugs, sometimes referred to as "shale burn compacts" or "shale burn plugs", have been installed on interior surfaces of support arms proximate portions of an associated cone assembly. Such diverter plugs may block or direct fluids containing downhole debris away from an associated fluid seal. Also, debris diverter grooves, sometimes referred to as "shale diverter grooves", have been formed in interior surfaces of support arms adjacent to an associated cutter cone assembly. Such diverter grooves may direct fluids containing downhole debris away from an associated fluid seal.

SUMMARY OF THE DISCLOSURE

In accordance with teachings of the present disclosure, various disadvantages and problems associated with prior roller cone drill bits may be reduced or eliminated. One aspect of the present disclosure may include extending the downhole drilling life of a roller cone drill bit by preventing small particles of shale, formation cuttings and other types of downhole debris from damaging associated fluid seals and bearing structures. For some applications, a roller cone drill bit may include at least one support arm having one or more diverter plugs biased towards contact with adjacent portions of an associated cone assembly. Packing of debris resulting from rotation of the cone assembly relative to the support arm with fluid containing debris disposed therebetween may be used to bias the diverter plug to maintain contact with the cone assembly.

For some embodiments each diverter plug may be installed in a respective hole large enough to allow longitudinal or axial movement of the diverter plug relative to the associated hole. One or more flow paths may be formed in an associated support arm to allow packing of debris beneath each diverter plug to maintain contact between one end of the diverter plug and adjacent portions of an associated cone assembly.

For some applications, a roller cone drill bit may be formed with at least one support arm having at least one hole with a diverter plug disposed therein and operable to move longitudinally or axially relative to the hole. For some applications, one or more fluid flow paths may be formed in each support arm adjacent to the hole to communicate fluid carrying shale, formation cuttings and other types of debris with a void space between the bottom of the hole and the diverter plug. During drilling of a wellbore, packing of debris in the void space may result in forcing the diverter plug outward to maintain contact between one end of the diverter plug and adjacent portions of the associated cone assembly.

Technical benefits of the present disclosure may also include using packed debris to bias or move a diverter plug to maintain contact with adjacent portions of an associated cone assembly to enhance protection of an associated fluid seal and bearing structure by blocking or directing fluid containing shale, formation cuttings and other types of debris away from an associated fluid seal and bearing structure. Biasing the diverter plug with packed debris may overcome problems related to determining appropriate depth for a hole and appropriate length for an associated diverter plug to accommodate manufacturing tolerances and specific dimensions of each cone assembly, associated bearing structure and/or spindle.

Springs and/or elastomeric material have previously been used to maintain contact between one end of a diverter plug and adjacent portions of a cone assembly and to compensate for wear of the diverter plug, cone assembly and/or associated spindle during drilling of a wellbore. The use of packed debris to maintain desired contact between a diverter plug and an associated cone assembly may reduce manufacturing costs associated with installing a spring or elastomeric material in a hole to bias the diverter plug. Problems associated with wear and/or damage related to using a spring or elastomeric material to apply biasing forces to a diverter plug while drilling a wellbore may also be eliminated.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE DISCLOSURE

Figure 1A:
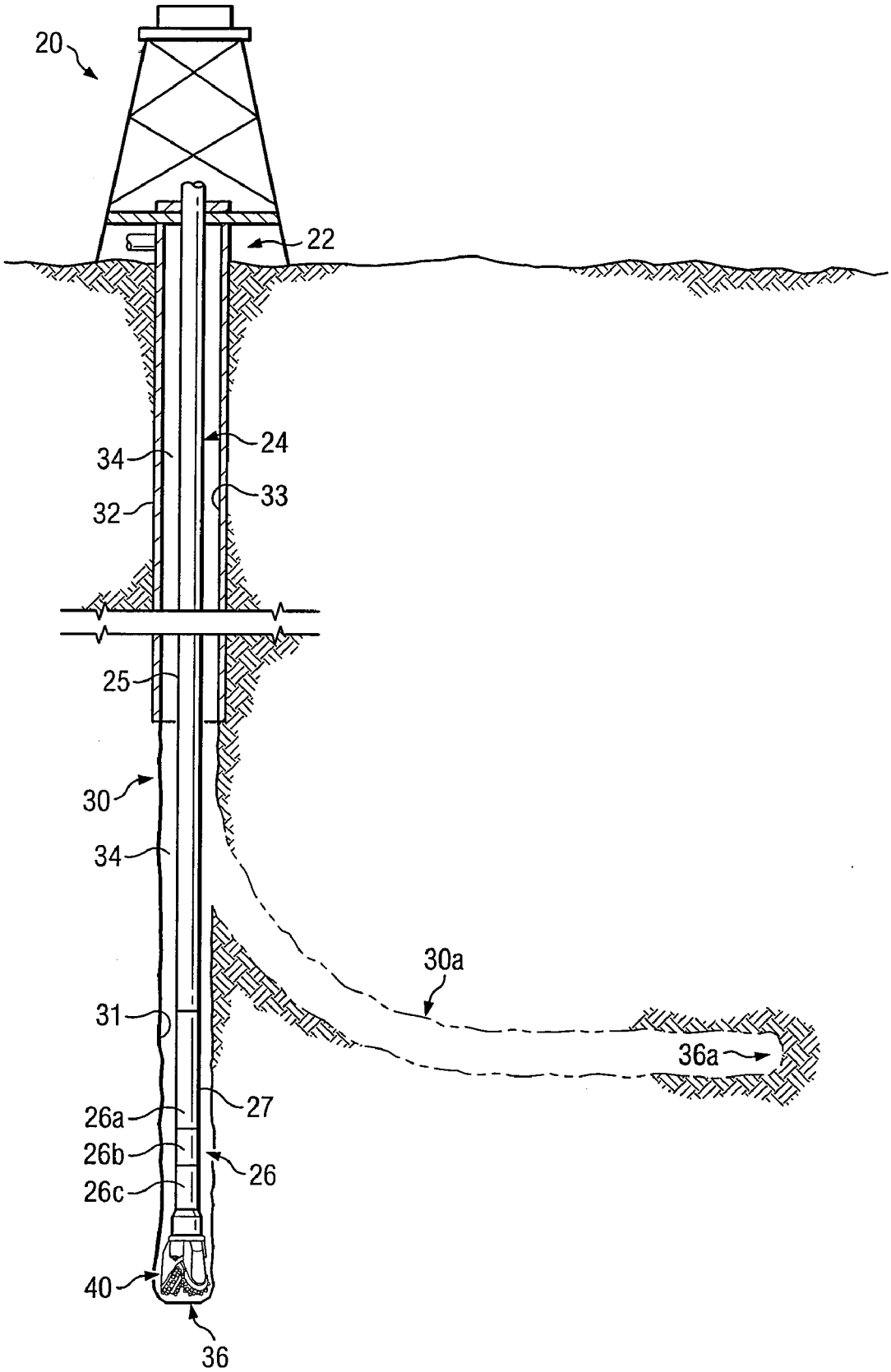
FIG. 1A is a schematic drawing in section and in elevation with portions broken away showing examples of wellbores which may be formed by a roller cone drill bit incorporating teachings of the present disclosure.

Preferred embodiments of the disclosure and its advantages are best understood by reference to FIGS. 1-8 wherein like number refer to same and like parts.

The term "debris" may be used in this application to refer to any type of material such as, but not limited to, formation cuttings, shale, abrasive particles, or other downhole debris associated with forming a wellbore in a subterranean formation using a roller cone drill bit.

The term "diverter plug" may be used in this application to include any shale burn plus, shale diverter plug, debris diverter plug and debris diverter insert which may be installed in a support arm of a roller cone drill bit. Such diverter plugs may be used to block or redirect the flow of fluid containing downhole debris away from fluid seals in associated cone assemblies.

The term "cone assembly" may be used in this application to include various types and shapes of roller cone assemblies and cutter cone assemblies rotatably mounted to a support arm. Cone assemblies may also be referred to as "roller cones" or "cutter cones." Cone assemblies may have a generally conical exterior shape or may have a more rounded exterior shape. Cone assemblies associated with roller cone drill bits generally point inwards towards each other. For some applications, such as roller cone drill bits having only one cone assembly, the cone assembly may have an exterior shape approaching a generally spherical configuration.

The term "cutting element" may be used in this application to include various types of compacts, inserts, milled teeth and welded compacts satisfactory for use with roller cone drill bits. The terms "cutting structure" and "cutting structures" may be used in this application to include various combinations and arrangements of cutting elements formed on or attached to one or more cone assemblies of a roller cone drill bit.

The term "bearing structure" may be used in this application to include any suitable bearing, bearing system and/or supporting structure satisfactory for rotatably mounting a cone assembly on a support arm. For example, a "bearing structure" may include inner and outer races and bushing elements to form a journal bearing, a roller bearing (including, but not limited to a roller-ball-roller-roller bearing, a roller-ball-roller bearing, and a roller-ball-friction bearing) or a wide variety of solid bearings. Additionally, a bearing structure may include interface elements such a bushings, rollers, balls, and areas of hardened materials used for rotatably mounting a cone assembly with a support arm.

The term "spindle" may be used in this application to include any suitable journal, shaft, bearing pin or structure satisfactory for use in rotatably mounting a cone assembly on a support arm. A bearing structure is typically disposed between adjacent portions of a cone assembly and a spindle to allow rotation of the cone assembly relative to the spindle and associated support arm.

The term "fluid seal" may be used in this application to include any type of seal, seal ring, backup ring, elastomeric seal, seal assembly or any other component satisfactory for forming a fluid barrier between adjacent portions of a cone assembly and an associated spindle. Examples of fluid seals associated with roller cone drill bits include, but are not limited to, O-rings, packing rings, and metal-to-metal seals.

The term "roller cone drill bit" may be used in this application to describe any type of drill bit having at least one support arm with a cone assembly rotatably mounted thereon. Roller cone drill bits may sometimes be described as "rotary cone drill bits," "cutter cone drill bits" or "rotary rock bits". Roller cone drill bits often include a bit body with three support arms extending therefrom and a respective cone assembly rotatably mounted on each support arm. Such drill bits may also be described as "tri-cone drill bits". However, teachings of the present disclosure may be satisfactorily used with drill bits having one support arm, two support arms or any other number of support arms and associated cone assemblies.

FIG. 1A is a schematic drawing in elevation and in section with portions broken away showing examples of wellbores or boreholes which may be formed by roller cone drill bits incorporating teachings of the present disclosure. Various aspects of the present disclosure may be described with respect to drilling rig 20 located at well surface 22. Various types of drilling equipment such as a rotary table, mud pumps and mud tanks (not expressly shown) may be located at well surface 22. Drilling rig 20 may have various characteristics and features associated with a "land drilling rig." However, roller cone drill bits incorporating teachings of the present disclosure may be satisfactorily used with drilling equipment located on offshore platforms, drill ships, semi-submersibles and drilling barges (not expressly shown).

Figure 1B:
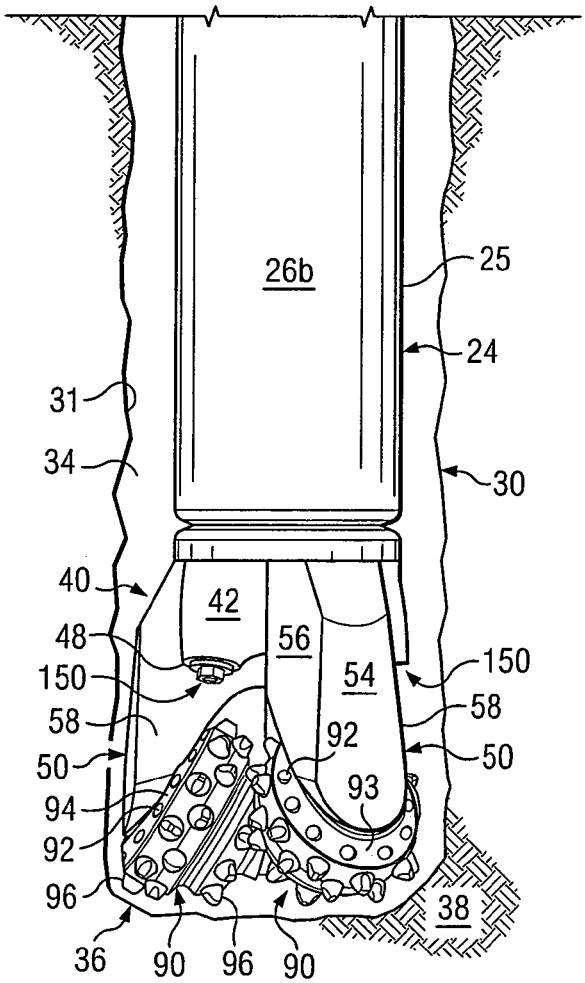
FIG. 1B is a schematic drawing in section and in elevation with portions broken away showing the drill string and attached roller cone drill bit of FIG. 1A adjacent to the bottom of a wellbore.
Figure 2:
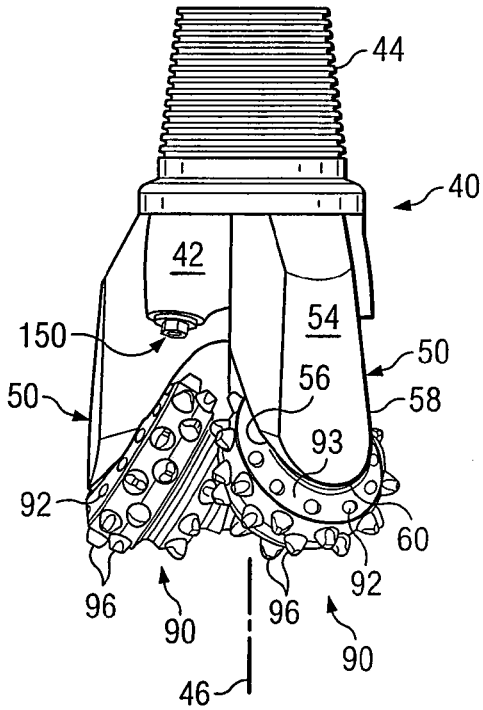
FIG. 2 is a schematic drawing in elevation showing a roller cone drill bit incorporating teachings of the present disclosure.

Roller cone drill bit 40 as shown in FIGS. 1A, 1B and 2 may be attached with the end of drill string 24 extending from well surface 22. Roller cone drill bits such as drill bit 40 typically form wellbores by crushing or penetrating a formation and scraping or shearing formation materials from the bottom of the wellbore using cutting elements which often produce a high concentration of fine, abrasive particles.

Drill string 24 may apply weight to and rotate roller cone drill bit 40 to form wellbore 30. Axis of rotation 46 of roller cone drill bit 40 may sometimes be referred to as "bit rotational axis". See FIG. 2. The weight of associated drill string 25 (sometimes referred to as "weight on bit") will generally be applied to roller cone drill bit 40 along bit rotational axis 46.

For some applications various types of downhole motors (not expressly shown) may also be used to rotate a roller cone drill bit incorporating teachings of the present disclosure. The present disclosure is not limited to roller cone drill bits associated with conventional drill strings.

Drill string 24 may be formed from sections or joints of generally hollow, tubular drill pipe (not expressly shown). Drill string 24 may also include bottom hole assembly 26 formed from a wide variety of components. For example components 26*a*, 26*b* and 26*c* may be selected from the group consisting of, but not limited to, drill collars, rotary steering tools, directional drilling tools and/or a downhole drilling motor. The number of components such as drill collars and different types of components in a bottom hole assembly will depend upon anticipated downhole drilling conditions and the type of wellbore which will be formed by drill string 24 and roller cone drill bit 40.

Roller cone drill bit 40 may be attached with bottom hole assembly 26 at the end of drill string 24 opposite well surface 22. Bottom hole assembly 26 will generally have an outside diameter compatible with other portions of drill string 24. Drill string 24 and roller cone drill bit 40 may be used to form various types of wellbores and/or boreholes. For example, horizontal wellbore 30*a*, shown in FIG. 1A in dotted lines, may be formed using drill string 24 and roller cone drill bit 40. Horizontal wellbores are often formed in "chalk" formations and other types of shale formations. Interaction between roller cone drill bit 40 and chalk or shale type formations may produce a large amount of fine, highly abrasive particles and other types of downhole debris.

Wellbore 30 may be defined in part by casing string 32 extending from well surface 22 to a selected downhole location. As shown in FIGS. 1A and 1B remaining portions of wellbore 30 may be described as "open hole" (no casing). Drilling fluid may be pumped from well surface 22 through drill string 24 to attached roller cone drill bit 40. The drilling fluid may be circulated back to well surface 22 through annulus 34 defined in part by outside diameter 25 of drill string 24 and inside diameter 31 of wellbore 30. Inside diameter 31 may also be referred to as the "side wall" of wellbore 30. For some applications annulus 34 may also be defined by outside diameter 25 of drill string 24 and inside diameter 33 of casing string 32.

The type of drilling fluid used to form wellbore 30 may be selected based on design characteristics associated with roller cone drill bit 40, anticipated characteristics of each downhole formation being drilled and any hydrocarbons or other fluids produced by one or more downhole formations adjacent to wellbore 30. Drilling fluids may be used to remove formation cuttings and other downhole debris (not expressly shown) from wellbore 30 to well surface 22. Formation cuttings may be formed by roller cone drill bit 40 engaging end 36 of wellbore 30. End 36 may sometimes be described as "bottom hole" 36. Formation cuttings may also be formed by roller cone drill bit 40 engaging end 36*a* of horizontal wellbore 30*a*. Drilling fluids may assist in forming wellbores 30 and/or 30*a* by breaking away, abrading and/or eroding adjacent portions of downhole formation 38. As a result drilling fluid surrounding roller cone drill bit 40 at end 36 of wellbore 30 may have a high concentration of fine, abrasive particles and other types of debris.

Drilling fluid is typically used for well control by maintaining desired fluid pressure equilibrium within wellbore 30. The weight or density of a drilling fluid is generally selected to prevent undesired fluid flow from an adjacent downhole formation into an associated wellbore and to prevent undesired flow of the drilling fluid from the wellbore into the adjacent downhole formation. Various additives may be used to adjust the weight or density of drilling fluids. Such additives and/or the resulting drilling fluid may sometimes be described as "drilling mud". Additives used to form drilling mud may include small, abrasive particles capable of damaging fluid seals and bearing structures of an associated roller cone drill bit. Sometimes additives (mud) in drilling fluids may accumulate on or stick to one or more surfaces of a roller cone drill bit.

Drilling fluids may also provide chemical stabilization for formation materials adjacent to a wellbore and may prevent or minimize corrosion of a drill string, bottom hole assembly and/or attached rotary drill bit. Drilling fluids may also be used to clean, cool and lubricate cutting elements, cutting structures and other components associated with roller cone drill bits 40.

Roller cone drill bit 40 may include bit body 42 having tapered, externally threaded, upper portion 44 satisfactory for use in attaching roller cone drill bit 40 with drill string 24. A wide variety of threaded connections may be satisfactorily used to attach roller cone drill bit 40 with drill string 24 and to allow rotation of roller cone drill bit 40 in response to rotation of drill string 24 at well surface 22.

An enlarged cavity (not expressly shown) may be formed adjacent to upper portion 42 to receive drilling fluid from drill string 24. Such drilling fluids may be directed to flow from drill string 24 to respective nozzles 150 provided in roller cone drill bit 40. A plurality of drilling fluid passageways (not expressly shown) may be formed in bit body 42. Each drilling fluid passageway may extend from the associated enlarged cavity to respective receptacle 48 formed in bit body 42. The location of receptacles 48 may be selected based on desired locations for nozzles 150 relative to associated cone assemblies 90.

Formation cuttings formed by roller cone drill bit 40 and any other downhole debris at end 36 of wellbore 30 will mix with drilling fluids exiting from nozzles 150. The mixture of drilling fluid, formation cuttings and other downhole debris will generally flow radially outward from beneath roller cone drill bit 40 and then flow upward to well surface 22 through annulus 34.

Roller cone drill bit 40, bit body 42, support arms 50 and associated cone assemblies 90 may be substantially covered by or immersed in a mixture of drilling fluid, formation cuttings and other downhole debris while drill string 24 rotates roller cone drill bit 40. This mixture of drilling fluid, formation cuttings and/or formation fluids may include highly abrasive materials.

Bit body 42 may be formed from three segments which include respective support arms 50 extending therefrom. The segments may be welded with each other using conventional techniques to form bit body 42. Only two support arms 50 are shown in FIGS. 1A, 1B and 2.

Each support arm 50 may be generally described as having an elongated configuration defined in part by interior surface 52 and exterior surface 54. Each support arm 50 may include respective spindle 70 extending inwardly from associated interior surface 52. Each support arm 50 may also include respective leading edge 56 and trailing edge 58 which terminate at respective end 60 spaced from bit body 42.

Portions of exterior surface 54 opposite from associated spindle 70 may sometimes be referred to as the "shirt tail" or "shirt tail surface" of each support arm 50. Exterior portions of each support arm 50 adjacent to respective end 60 may sometimes be described as the "shirt tail tip". Interior surface 52 and exterior surface 54 of each support arm 50 are generally contiguous with each other along respective leading edge 56, trailing edge 58 and respective end 60.

Spindles 70 may be angled downwardly and inwardly with respect to associated interior surfaces 52. As a result, exterior portions of each cone assembly 90 may engage the bottom or end 36 of wellbore 30 as roller cone drill bit 40 is rotated by drill string 24. For some applications spindles 70 may be tilted at an angle of zero to three or four degrees in the direction rotation of roller cone drill bit 40.

Cone assemblies 90 may be rotatably mounted on respective spindles 70 extending from each support arm 50. Each cone assembly 90 may include respective axis of rotation 100 extending at an angle corresponding generally with the angular relationship between associated spindle 70 and support arm 50. Axis of rotation 100 for each cone assembly 90 generally corresponds with the longitudinal center line or longitudinal axis of associated spindle 70. The axis of rotation of each cone assembly 90 may be offset relative to longitudinal axis or rotational axis 46 of roller cone drill bit 40. See FIG. 2.

Various types of retaining systems and locking systems may be satisfactorily used to securely engage each cone assembly 90 with associated spindle 70. For some applications a ball passageway (not expressly shown) may be formed extending from exterior surface 54 through associated spindle 70. Each cone assembly 90 may be retained on associated spindle 70 by inserting a plurality of ball bearings 78 through the associated ball passageway. Ball bearings 78 may be disposed within respective ball races 76 and 106 formed on adjacent portions of spindle 70 and cavity 102 of associated cone assembly 90. A ball retainer plug (not expressly shown) may also be inserted into the ball passageway. Once inserted, ball bearings 78 and ball races 76 and 106 cooperate with each other to prevent disengagement of cone assembly 90 from associated spindle 70.

For some applications a plurality of compacts 92 may be disposed in gage surface 93 adjacent to backface 94 of each cone assembly 90. Compacts 92 may be used to prevent wear to gage surface 93 adjacent to backface 94 of associated cone assembly 90. Backface 94 may sometimes be referred to as a "base" for associated cone assembly 90.

Each cone assembly 90 may also include a plurality of cutting elements 96 arranged in respective rows formed on the exterior of each cone assembly 90 between associated cone backface 94 and cone tip 98. A gage row of cutting element 96 may be disposed adjacent to backface 94 of each cone assembly 90. The gage row may also sometimes be referred to as the "first row" of inserts.

Compacts 92 and cutting elements 96 may be formed from a wide variety of materials such as tungsten carbide. The term "tungsten carbide" includes monotungsten carbide (WC), ditungsten carbide ($W_2C$), macrocrystalline tungsten carbide and cemented or sintered tungsten carbide. Examples of hard materials which may be satisfactorily used to form compacts 92 and cutting elements 96 may include various metal alloys and cermets such as metal borides, metal carbides, metal oxides and metal nitrides. For some applications compacts 92 and/or inserts 96 may be formed from polycrystalline diamond type materials or other suitable hard, abrasive materials.

Cutting elements 96 may scrape and gouge the sides and bottom of wellbore 30 in response to weight and rotation applied to roller cone drill bit 40 by drill string 24. The interior diameter or side wall 31 of wellbore 30 correspond approximately with the combined outside diameter of cone assemblies 90 attached with roller cone drill bit 40.

The position of cutting elements 96 on each cone assembly 90 may be varied to provide desired downhole drilling action. Other types of cone assemblies may be satisfactorily used with the present disclosure including, but not limited to, cone assemblies having milled teeth (not expressly shown) instead of cutting elements 96.

Various types of bearing structures may be used to rotatably mount each cone assembly 90 on associated spindle 70. For example, each spindle 70 may include generally cylindrical exterior surfaces such as bearing surface 74. Each cone assembly 90 may include respective cavity 102 extending inwardly from associated backface 94. Each cavity 102 may include generally cylindrical interior surfaces such as bearing surface 104. The cylindrical portions of each cavity 102 may have a respective inside diameter which is generally larger than the outside diameter of an adjacent cylindrical portion of spindle 70.

Variations between the inside diameter of each cavity 102 and outside diameter of associated spindle 70 are selected to accommodate the associated bearing structure and allow rotation of each cone assembly 90 relative to associated spindle 74 and adjacent portions of support arm 50. The actual difference between the outside diameter of bearing surface 74 and the inside diameter of bearing surface 104 may be relatively small to provide desired bearing support or rotational support for each cone assembly 90 relative to associated spindle 70.

Bearing surfaces 74 and 104 support radial loads resulting from rotation of cone assembly 90 relative to associated spindle 70. Thrust flange 82 may be formed on spindle 70 between ball race 76 and pilot bearing surface 84. Thrust flange 82 typically supports axial loads resulting from weight on roller cone bit 40 and rotation of cone assembly 90 relative to associated spindle 70. For some applications thrust button or thrust bearing 80 may also be provided in cavity 102 of each cone assembly 90 at the end of spindle 70 opposite from associated support arm 50. Additional radial and axial loads may be supported by other components of roller cone bit 40.

A generally cylindrical gap may be formed between exterior portions of spindle 70 and interior portions of cavity 102 of associate cone assembly 90. The generally cylindrical gap may be defined in part by adjacent bearing surface 74 and 104. The generally cylindrical gap may also include segments of spindle 70 and cavity 102 adjacent to fluid seal 108.

One or more machined surfaces are often formed on the interior surface of a support arm adjacent to and extending from an associated spindle. For embodiments such as shown in FIGS. 3, 4A, 5, 7 and 8 each support arm 50 may be generally described as having respective machined surfaces 64 extending radially from associated spindle 70. Machined surfaces 64 may terminate proximate leading edge 56, trailing edge 58 and shirt tail tip 60 of associated support arm 50.

Figure 3:
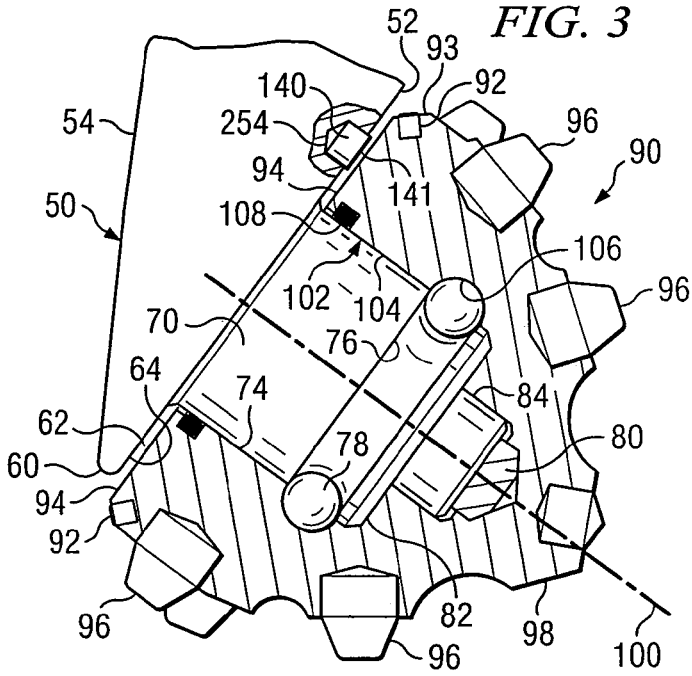
FIG. 3 is a schematic drawing partially in section and partially in elevation with portions broken away showing a support arm and cone assembly incorporating teachings of the present disclosure.
Figure 4A:
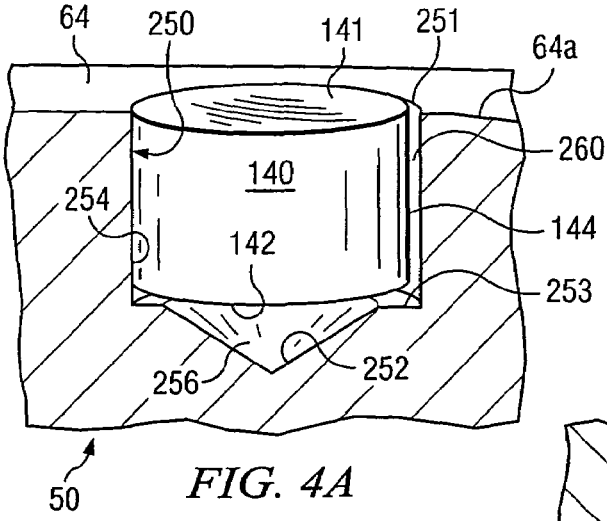
FIG. 4A is a schematic drawing in section showing portions of a support arm and diverter plug incorporating teachings of the present disclosure with the diverter plug in a first, retracted position.
Figure 4B:
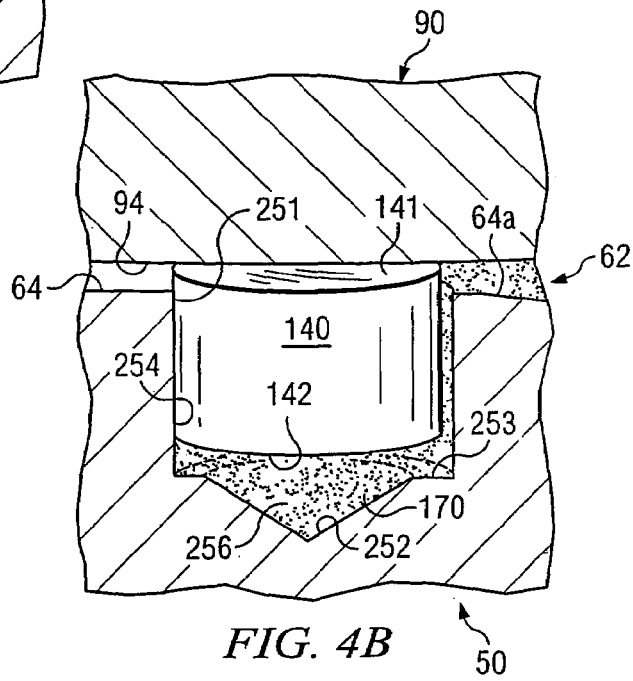
FIG. 4B is a schematic drawing in section showing portions of the support arm and diverter plug of FIG. 4A with the diverter plug in a second, extended position engaged with adjacent portions of an associated cone assembly.
Figure 5:
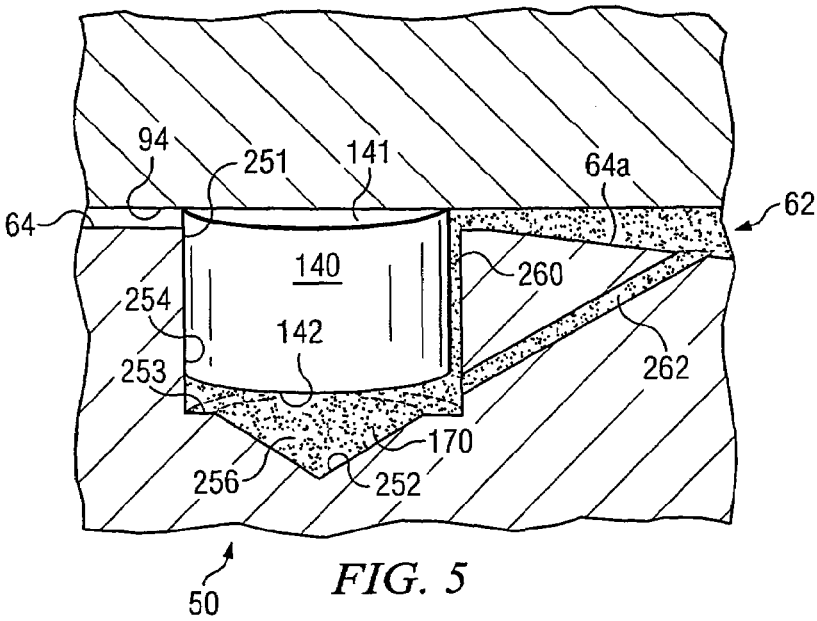
FIG. 5 is a schematic drawing in section showing portions of a support arm with a diverter plug extending from the support arm and engaged with adjacent portions of an associated cone assembly in accordance with another embodiment.

As shown in FIGS. 3, 4B and 5 gap 62 may be formed between cone backface 94 and adjacent portions of machined surface 64 formed on interior surface 52 of associated support arm 50. Gap 62 may sometimes be generally described as a "clearance gap". Gap 62 allows rotation of each cone assembly 90 relative to machined surfaces 64 of associated support arm 50. Gap 62 also extends from and communicates with the generally cylindrical gap formed between exterior portions of spindle 70 and interior portions of cavity 102 of associated cone assembly 90.

Each support arm 50 may include a lubricant system (not expressly shown) having a lubricant reservoir, lubricant pressure compensator and one or more lubricant passageways to provide lubrication to various components of associated spindle 70 and cone assembly 90. One or more passageways, not expressly shown, may be provided within spindle 70 to supply lubrication to bearing surfaces 74 and 104, ball races 76 and 106, thrust bearing flange 82 and/or other bearing components.

One or more fluid seals may be provided to block fluid communication through the generally cylindrical gap formed between exterior portions of spindle 70 and interior portions of cavity 102 in associated cone assembly 90. As shown in FIG. 3, fluid seal 108 may be engaged with exterior portions of spindle 70 and interior portions of cavity 102 located between bearing surfaces 74 and 104 and machined surface 64 formed on interior surface 52 of associated support arm 90. For some applications fluid seal 108 may include a seal ring or packing disposed in a seal gland (not expressly shown).

Fluid seal 108 may be used to block the flow of drilling fluid and any other fluid containing debris from communicating with bearing surfaces 74, 104 and ball races 76 and 106. Fluid seal 108 may also form a fluid barrier to prevent lubricant contained between cavity 102 and spindle 70 from exiting therefrom. Fluid seals 108 protect associated bearing structures from loss of lubricant and from contamination with debris and thus prolong the downhole drilling life of roller cone drill bit 40.

Figure 7:
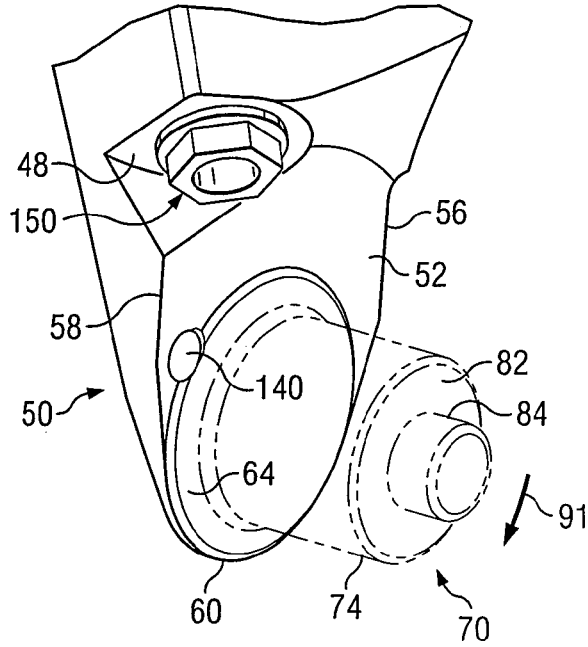
FIG. 7 is a schematic drawing showing an isometric view with portions broken away of support arm and diverter plug incorporating teachings of the present disclosure.
Figure 8:
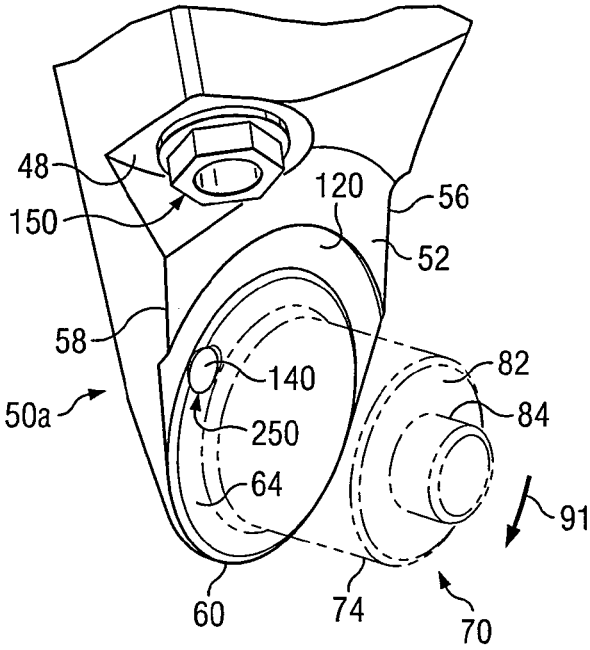
FIG. 8 is a schematic drawing showing an isometric view with portions broken away of a support arm and diverter plug incorporating teachings of the present disclosure with the diverter plug disposed adjacent to a diverter groove formed in the support arm.

Drilling fluid containing formation cuttings and other types of downhole debris may enter into gap 62 formed between machined surface 64 of support arm 50 and backface 94 of associated cone assembly 90. Rotation of cone assembly 90 often results in forcing (pumping) drilling fluid or other fluids containing debris from gap 62 into the generally cylindrical gap formed between spindle 70 of support arm 50 and associated cone assembly 90. Arrow 91 as shown in FIGS. 7 and 8 indicates the general direction of rotation of cone assembly 90 relative to spindle 70 and associated machined surface 64.

The movement of such fluid may often result in packing debris against associated fluid seal 108 causing the debris to form a substantially solid layer or layers (not expressly shown). The layer or layers of debris may force fluid seal 108 to move axially in an associated seal gland (not expressly shown) until fluid seal 108 reaches the end of the seal gland where continued forces (packing of debris) may increase the pressure on fluid seal 108 beyond the design range of associated seal materials. Packing of debris will be discussed in more detail with respect to FIGS. 4A, 4B and 5.

For some applications one or more diverter plugs 140 may be disposed in machined surface 64 of each support arm 50 spaced from associated spindle 70. Diverter plugs 140 may block or restrict drilling fluid and any other fluid containing downhole debris from being forced (pumped) from gap 62 into the generally cylindrical gap formed between spindle 70 and cavity 102 of associated cone assembly 90. As a result diverter plugs 140 may substantially minimize or eliminate packing of downhole debris against associated fluid seal 108.

One aspect of the present disclosure may include installing one or more diverter plugs in respective holes formed in an interior surface of a support arm such that each diverter plug may move longitudinally or axially with respect to the associated hole. One or more fluid passageways may be provided in the support arm to allow debris to lift or extend each diverter plug from the associated hole until one end of each diverter plug contacts adjacent portions of an associated cone assembly. Maintaining contact between one end of each diverter plug and adjacent portions of the associated cone assembly may help to block or direct drilling fluids and any other fluids containing debris away from an associated fluid seal. FIGS. 3-8 show some examples roller cone drill bit support arms with diverter plugs installed therein in accordance with teachings of the present disclosure.

For embodiments such as shown in FIGS. 3-8 one or more holes 250 may be formed in machined surface 64 of each support arm 50 at a desired location relative to associated spindle 70 and cone assembly 90. For some applications hole 250 may be formed adjacent to leading edge 56 of associated support arm 50. For other applications hole 250 may be formed adjacent to trailing edge 58 of associated support arm 50. See FIGS. 7 and 8. For still other applications first hole 250 may be formed adjacent to leading edge 56 and second hole 250 may be formed adjacent to trailing edge 58 (not expressly shown). Hole 250 may also be located adjacent to a debris diverter groove formed in an interior surface of an associated support arm. See FIG. 8.

Diverter plug 140 may be described as having a generally cylindrical configuration defined in part by first end 141 and second end 142. The length of diverter plug 140 may be approximately equal to or less than the depth of associated hole 250. Outside diameter 144 of diverter plug 140 may be less than inside diameter 254 of associated hole 250. In an alternate embodiment the length of diverter plug 140 may be slightly longer than the depth of associated hole 250. The difference between outside diameter 144 of diverter plug 140 and inside diameter 254 of associated hole 250 may result in diverter plug 140 being operable to move between a first, retracted position relative to hole 250 and a second, extended position relative to hole 250. See FIGS. 4A and 4B.

Figure 9A:
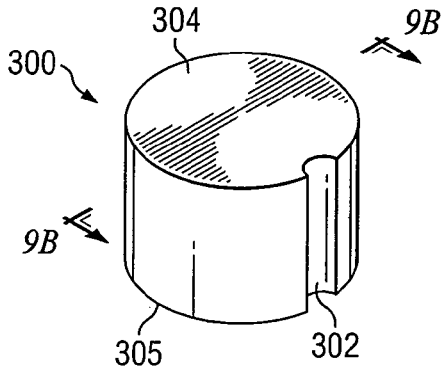
FIGS. 9A and 9B are schematic diagrams showing a diverter plug having an internal fluid passage.
Figure 9B:
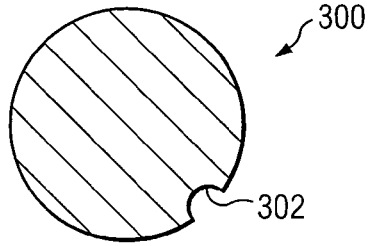

Various techniques may be satisfactorily used to provide one or more fluid passageways operable to communicate drilling fluid and other fluids containing debris from gap 62 to second end 142 of diverter plug 140. One technique may be to form diverter plug 140 with outside diameter 144 which is slightly less than the inside diameter 254 of associated hole 250. Another technique may be to form portions of inside diameter of hole 250 with one or more enlarged segments. See FIG. 6. Still another technique may be to form one or more channels (as shown in FIGS. 9A and 9B) in the exterior of diverter plug 140. Such channels may extend between first end 141 and second end 142.

Hole 250 may be formed in machined surface 64 using various techniques. Hole 250 may include opening or first end 251 adjacent to machined surface 64. Hole 250 may also include bottom or second end 252 disposed within support arm 50. Void space 256 may be formed between second end 142 of diverter plug 140 and second end or bottom 252 of hole 250 Annular shoulder 253 may also be formed in hole 250 adjacent to second end 252. Void space 256 may be formed by the tip of a drill bit used to form hole 250. Alternatively, a void space may be provided between the bottom of hole 252 and end 142 of diverter plug 140 by varying the length of diverter plug 140 relative to the depth of associated hole 250 or forming a cavity (not expressly shown) in second end 142 of diverter plug 140.

As previously discussed, rotation of a cone assembly relative to machined surfaces formed on an associated support arm often results in packing of downhole debris against associated fluid seals. This same packing action may be used to pump or force drilling fluids or other fluids containing downhole debris to flow through one or more fluid passageways in support arm 50 operable to communicate with void space 256 and/or second end 142 of diverter plug 140. Debris represented by gray dots 170 in FIGS. 4 and 5 may then accumulate or be packed into void space 256 adjacent to second end 142 of associated diverter plug 140.

For embodiments such as shown in FIG. 5, one or more fluid flow paths 262 may be formed in groove or channel 64*a* of support arm 50 to directly communicate with void space 256. Fluid flow paths 262 may increase the flow of fluid containing downhole debris into and out of associated void space 256 as compared with only fluid flow path 260.

Figure 6:
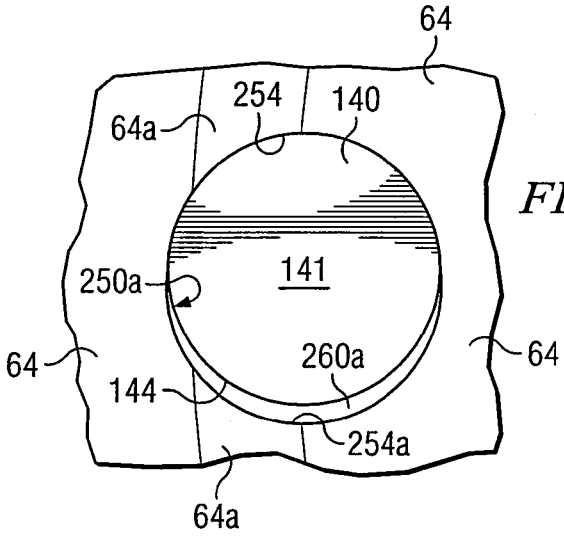
FIG. 6 is a schematic drawing showing a plan view with portions broken away of a diverter plug slidably disposed in a hole formed in a support arm in accordance with teachings of the present disclosure.

For some applications such as shown in FIGS. 5 and 6, groove or channel 64*a* may also be formed adjacent to hole 250 by removing portions of machined surface 64 to increase the fluid flow area between backface 94 of associated cone assembly 90 and channel 64*a*. Channel 64*a* may help to direct fluid containing downhole debris into fluid flow paths 260 and/or 262 of associated hole 250.

For some applications such as shown in FIG. 6 hole 250*a* may be formed with approximately the same outside diameter as previously discussed hole 250 except for segment 254*a*. Alternately, hole 250*a* may have an outside diameter that is smaller or larger than the outside diameter of previously discussed hole 250. Segment 254*a* of hole 250*a* may have a radius larger than the radius corresponding with diameter 254 to create fluid flow path 260*a*.

Fluid flow paths 260, 260*a* and/or 262 may allow drilling fluid and other fluids to pack formation cuttings and other types of debris into void space 256. Packing debris 170 into void space 256 may force diverter plug 140 to move from a first, retracted position (See FIG. 4A) to a second extended position (See FIG. 4B). The packing of debris 170 into void space 256 may be used to bias or force first end 141 of diverter plug 140 to contact adjacent portions of backface 94 of associated cone assembly 90.

During the drilling of wellbore 30 and/or 30*a*, cone assemblies 90, spindles 70 and/or various portions of support arm 50 may experience wear. Such wear often results in increasing the thickness or size of gap 62. By continuing to pack debris (represented by dots 170) into void space 256, diverter plug 140 may continue to move or extend longitudinally from associated hole 250 to maintained contact between first end 141 and backface 94 of associated cone assembly 90. As shown in FIG. 4B contact between first end 141 and second end and adjacent portions of backface 94 may block drilling fluid or other fluids containing debris 170 from flowing therebetween.

Machined surfaces 64, spindle 70 and cavity 102 of cone assembly 90 are typically manufactured with dimensions that satisfy appropriate design tolerances. As a result of such manufacturing tolerances, it may often be difficult to determine the specific depth for a hole and/or length of an associated diverter plug required to maintain desired contact with the backface of an associated cone assembly. One of the benefits of the present disclosure includes eliminating or substantially reducing concerns with variations in the actual dimensions of machined surface 64, spindle 70, cavity 108, hole 250 and associated diverter plug 140. The present disclosure allows drilling hole 250 with sufficient depth to accommodate manufacturing tolerances since debris 170 may continue to fill void space 256 until first surface 141 of diverter plug 140 has contacted adjacent portions of backface 94.

FIG. 7 is a schematic drawing showing an isometric view of support arm 50 with diverter plug 140 disposed in associated hole 250 adjacent to trailing edge 58 support arm 50. The location of hole 250 and associated diverter plug 140 may be varied in accordance with teachings of the present disclosure to optimize the volume of fluid which will be blocked or directed away from associated fluid seal 108.

For applications such as shown in FIG. 8, debris diverter groove 120 may be formed in interior surface 52 extending from trailing edge 58 to leading edge 56 of support arm 50*a*. Diverter groove 120 may provide a fluid flow path having a larger fluid flow area as compared with relatively small gap 62 formed between adjacent portions of backface 94 and machined surface 64. As a result diverter groove 120 may divert or direct drilling fluid and any other fluids containing debris away from associated fluid seal 108. Installing diverter plug 140 in hole 250 adjacent to debris diverter groove 120 may further increase the volume of fluid containing debris that is directed away from associated fluid seal 108.

Installing one or more diverter plugs in a support arm of a roller cone drill bit in accordance with teachings of the present disclosure may substantially reduce the volume of drilling fluid or other fluids containing debris which will be "pumped" or packed into a gap formed between an associated spindle and cone assembly. Reducing the volume of drilling fluid or other fluids flowing into the gap will substantially reduce and/or eliminate packing of downhole debris against associate fluid seals. As a result, associated fluid seals and bearing structures protected by such fluid seals may have an increased downhole drilling life. Increasing the downhole drilling life of fluid seals and bearing structures will often increase the downhole drilling life of an associated roller cone drill bit.

FIGS. 9A and 9B show a diverter plug 300 having a generally cylindrical configuration defined in part by first end 304 and second end 305. Diverter plug 300 further includes fluid passage 302 formed on an exterior surface thereon. Fluid passage 302 may also be formed to extend through the body of diverter plug 300 (not expressly shown). In one embodiment, diverter plug 300 may be disposed in hole 250 of support arm 50 as shown, for example, in FIG. 4A. Fluid passage 302 may allow drilling fluid and other fluids to pack formation cuttings and other types of debris into void space 256 (as shown in FIGS. 4A, 4B and 5) and to otherwise allow fluid to communicate between first end 304 and second end 305.

Figure 10A:
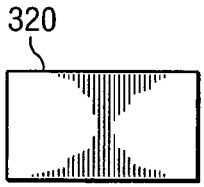
FIGS. 10A-D are schematic diagrams of non-cylindrical diverter plugs in accordance with teachings of the present disclosure.
Figure 10B:
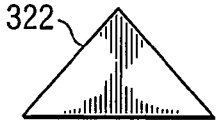
Figure 10C:
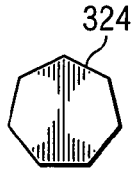
Figure 10D:
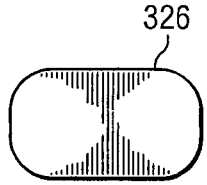

In alternate embodiments, hole 250, as shown in FIG. 4A, may have a non-cylindrical configuration. FIGS. 10A-D show cross-sectional views of non-cylindrical plugs for use in non-cylindrical holes. FIG. 10A shows plug 220 having a generally rectangular configuration for use with a support arm hole having a complimentary rectangular configuration (not expressly shown). FIG. 10B shows plug 222 having a generally triangular configuration for use with a support arm hole having a complimentary triangular configuration (not expressly shown). FIG. 10C shows plug 224 having a generally octagonal cross-section for use with a complimentary support arm hole (not expressly shown). FIG. 10D shows plug 226 having a generally rectangular shape with rounded corners for insertion into a complimentary support arm hole (not expressly shown). In other embodiments, a support arm hole and plug may have any suitable geometry.

Figure 11A:
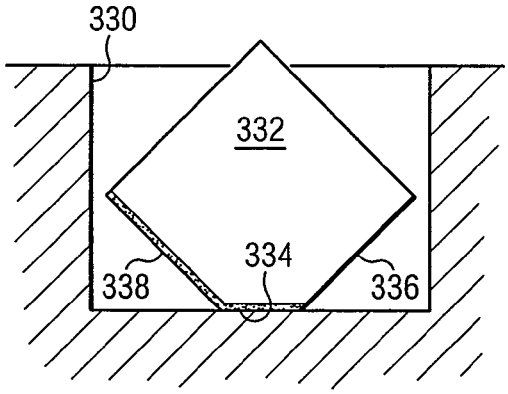
FIGS. 11A and 11B are schematic diagrams of a rocking plug in accordance with teachings of the present disclosure.
Figure 11B:
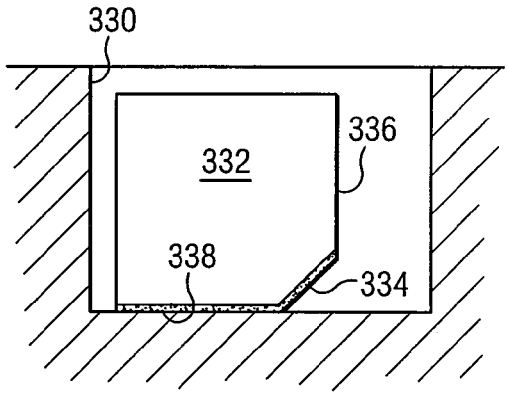

FIGS. 11A and 11B show a cross-section of a so-called "rocking" plug 332. Rocking plug 332 has a partially rectangular cross-sectional configuration for insertion into support arm hole 330 (which is analogous to hole 250 discussed above). Rocking plug 332 is not rectangular in that side 334 bridges sides 336 and 338, creating pentagonal cross-section. Side 334 allows plug 332 to rotate or "rock" within hole 330 in response to pressure from drilling fluid, cuttings or other fluids. FIGS. 11A and 11B show plug 332 rotated in different positions.

Although the present disclosure and its advantages have been described in detail, it should be understood that various changes, substitutions and alterations can be made herein without departing from the spirit and scope of the disclosure as defined by the following claims.

What is claimed is:

1. A roller cone drill bit comprising:

a bit body having at least one support arm extending therefrom;

each support arm having an interior surface and an exterior surface with a spindle extending inwardly from the interior surface;

a respective cone assembly rotatably mounted on each spindle;

each cone assembly having a backface disposed adjacent to and spaced from the interior surface of the associated support arm;

at least one hole formed in the interior surface of each support arm;

each hole extending from an opening in the interior surface of the associated support arm to a closed end disposed within the associated support arm;

a respective debris diverter plug slidably disposed within each hole;

each debris diverter plug having a first end operable to extend from the respective hole and a second end disposed within the respective hole;

at least one fluid passageway extending from the interior surface of the associated support arm to a location proximate the second end of the associated debris diverter plug; and each fluid passage operable to communicate fluid containing debris between the interior surface of the associated support arm and the second end of the diverter plug.

2. The roller cone drill bit of claim 1 further comprising:

a void space disposed between the second end of each diverter plug and the closed end of the respective hole; and each void space operable to accumulate debris and bias the associated debris diverter plug to move out of the respective hole to engage the first end of the associated debris diverter plug with the backface of the respective cone assembly.

3. The roller cone drill bit of claim 1 further comprising:

each debris diverter plug having a first diameter and the associated hole having a second diameter;

the first diameter of each debris diverter plug less than the second diameter of the hole;

the first diameter of each diverter plug cooperating with the second diameter of the associated hole to allow the first end of the diverter plug to move outwardly from the hole; and the second diameter of the hole having an enlarged segment operable to form the at least one fluid passageway extending from the exterior surface of the associated support arm to the associated void space proximate the second end of the debris diverter plug.

4. The roller cone drill bit of claim 1 further comprising:

at least one second fluid passageway formed in the first surface of the associated support arm;

each second fluid passageway having a respective first end formed in the interior surface of the associated support arm and space from the associated hole; and a second end of each second fluid passageway communicating with the second end of the respective diverter plug disposed in the associated hole.

5. The roller cone drill bit of claim 1 further comprising:

a respective hole formed on the interior surface of each support arm adjacent to the leading edge of each support arm and a second hole form on the interior surface of each support arm adjacent to the trailing edge;

a debris diverter plug slidably disposed in the first hole and a second debris diverter plug slidably disposed within the second hole; and a respective fluid passageway communicating with a void space proximate the second end of the first diverter plug and the second end of the second diverter plug.

6. The roller cone drill bit of claim 1 further comprising each hole having a cross-section slightly larger than the cross-section of the associated debris diverter plug.

7. The roller cone drill bit of claim 1 further comprising:

at least one machined surface formed on the interior surface of each support arm adjacent to the associated spindle; and each hole disposed in the machined surface of the associate support arm.

8. The roller drill bit of claim 7 further comprising a debris diverter groove formed in the machined surface and at least a portion of each hole disposed in the associated debris diverter groove.

9. The roller cone drill bit of claim 1 further comprising a void space operable to accumulate debris and bias the debris diverter plug to move outwardly from the hole by a build-up of debris in the void space.

10. The roller drill bit of claim 1 wherein at least one debris diverter plug comprises a fluid passage formed an exterior surface thereof operable to communicate fluid containing debris between the first end of the diverter plug and the second end of the diverter plug.

11. The roller cone drill bit of claim 1 wherein at least one diverter plug has a triangular cross-section.

12. The roller cone drill bit of claim 1 wherein at least one diverter plug has a square cross-section.

13. The roller cone drill bit of claim 1 wherein at least one diverter plug has an octagonal cross-section.

14. The roller cone drill bit of claim 1 wherein at least one diverter plug has a generally square cross-section with rounded corners.

15. The roller cone drill bit of claim 1 wherein at least one diverter plug comprises a rocking plug.

16. A method to enhance protection of fluid seals and bearing structures associated with a roller cone drill bit with at least one hole formed in an interior surface of an associated support arm while drilling a wellbore using the roller cone drill bit comprising:

directing fluid containing downhole debris through at least one passageway extending from the interior surface of the associated support arm of the drill bit to a void space formed between a closed end of the at least one hole and a second end of a divert plug disposed in the at least one hole; and filling the void space with debris to bias the diverter plug to move axially relative to the at least one hole until a first end of the diverter plug contacts adjacent portions of an associated cone assembly rotatably mounted on a spindle extending from the interior surface of the associated support arm.

17. The method of claim 16 further comprising maintaining contact between the first end of the debris diverter plug and adjacent portions of the associated cone assembly during wear of portions of the associated cone assembly and associated support arm by packing additional debris in the void space.

18. A method of forming a roller cone drill bit having at least one support arm comprising:

forming at least one hole extending from an opening in an interior surface of each support arm to a closed end spaced from the interior surface of the support arm;

inserting a debris diverter plug having a first end and a second end into each hole with the second end of the associated diverter plug disposed adjacent to the closed end of the associated hole; and forming at least one fluid passageway extending from the interior surface of each support arm to the associated void space formed between the second end of the respective debris diverter plug and the closed end of the associated hole.

19. The method of claim 18 further comprising forming a respective second fluid passageway extending from the interior surface of the support arm to each void space with the respective second fluid passageway offset from the associated first fluid passageway.

20. The method of claim 18 further comprising forming each hole having an inside diameter which is larger than an associated outside diameter of the respective debris diverter plug to provide at least a portion of the first fluid passageway.

* * * * *